US008717164B2

(12) United States Patent
Williams et al.

(10) Patent No.: US 8,717,164 B2
(45) Date of Patent: May 6, 2014

(54) INTEGRATED SECURITY SYSTEM FOR WARNING OF DANGEROUS SUBSTANCES THAT ARE DISPERSED BY WINDS

(75) Inventors: Larry Eugene Williams, Levelland, TX (US); Nickey Joe Williams, Levelland, TX (US); Benny Ray Sherrod, Midland, TX (US); Roger Dale Hayes, Amarillo, TX (US)

(73) Assignee: Wind Willie, LLC

( * ) Notice: Subject to any disclaimer, the term of this patent is extended or adjusted under 35 U.S.C. 154(b) by 511 days.

(21) Appl. No.: 13/066,382

(22) Filed: Apr. 13, 2011

(65) Prior Publication Data

US 2012/0188074 A1 Jul. 26, 2012

Related U.S. Application Data

(63) Continuation-in-part of application No. 12/576,395, filed on Oct. 9, 2009.

(51) Int. Cl.
*G08B 21/00* (2006.01)

(52) U.S. Cl.
USPC ..... 340/539.11; 340/573.1; 73/170.01; 455/404.1

(58) Field of Classification Search
USPC ..... 340/539.1, 539.11, 573.1, 572.1, 632; 455/404.1; 73/170.01
See application file for complete search history.

(56) References Cited

U.S. PATENT DOCUMENTS

| | | | | |
|---|---|---|---|---|
| 2007/0132601 | A1* | 6/2007 | Al-Wehebi | 340/632 |
| 2007/0223841 | A1* | 9/2007 | Weinzapfel et al. | 382/325 |
| 2011/0027781 | A1* | 2/2011 | Langlois et al. | 435/6 |

* cited by examiner

*Primary Examiner* — Jeffery Hofsass
(74) *Attorney, Agent, or Firm* — Shannon L Warren

(57) ABSTRACT

An integrated security system for oil-field and gas-field sites is disclosed. The system utilizes state-of-the-art technologies including "logical QR emblems" and powerful, advanced RFID tags. The system is particularly valuable for emergency responders, since it facilitates immediate, secure display of critical site data-according to predetermined classifications, e.g., emergency triage for an accident or terrorist event.

12 Claims, 9 Drawing Sheets

Figure 1:
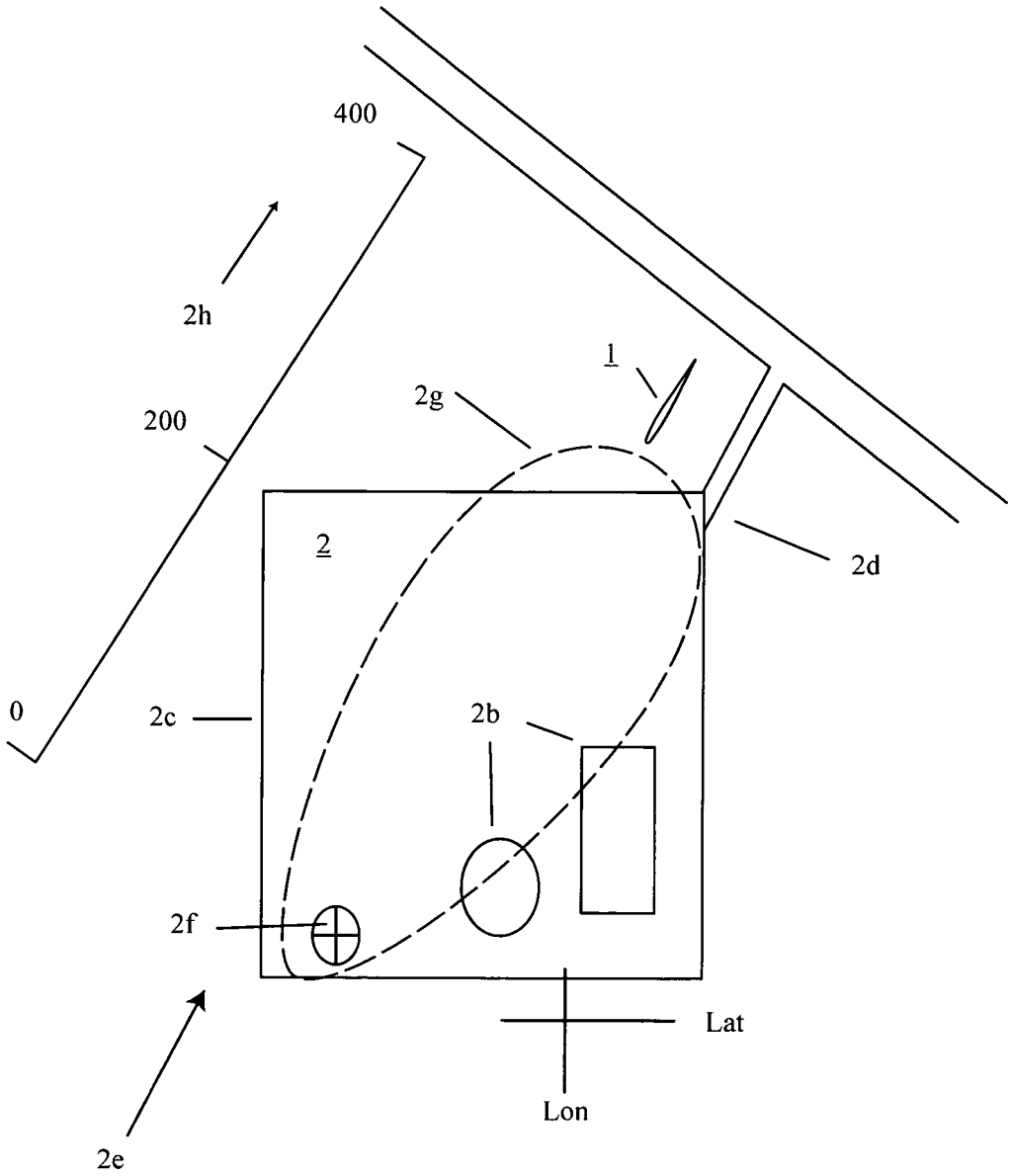

INTEGRATED SECURITY SYSTEM FOR WARNING OF DANGEROUS SUBSTANCES THAT ARE DISPERSED BY WINDS

CROSS-REFERENCE TO RELATED APPLICATION

This is a Continuation in Part application claiming the priority of application Ser. No. 12/576,395, filed 9 Oct. 2009.

FEDERALLY SPONSORED RESEARCH

Not Relevant

SEQUENCE LISTING

Not Relevant

BACKGROUND OF THE INVENTION

In general, previous articulated, customizable signs fall into several US Classes including: 116, 73, D10 and D20. At this moment no class description could be found which includes the concepts of warning signs with special utility or application toward instantaneous display of specific predetermined topic-related displays by means of RFID systems or web-related QR codes. Searching in April 2011 confirmed the existence of about 113 grants with the text string "warning sign" in the claims. Upon close inspection, none was found which discloses or claims dynamic security systems with real-time web links especially configured for support of first-responders in accidents or terrorist attacks. Presumably, if there were applications which disclose actual apparatus, methods and systems similar to those of the present invention, they would already be held as secret within the USPTO under national security provisions, 35 USC 181.

BRIEF SUMMARY OF THE INVENTION

Global political and economic conditions now require extraordinary security for oil and gas facilities, especially remote wells, pipelines and field-processing sites. Part of this challenge is to provide reliable, secure, instant access to infrastructure records, data and emergency procedures to authenticated individuals having a confirmed need to know and to federal/state governmental agencies, especially the US Dept. of Homeland Security. Normal safety aspects toward the adjoining communities, e.g., warning signs and standard response procedures for a well are typically covered by the property owner or licensee. Compliance of each site with state and industry codes (API, American Petroleum Institute) for natural gas-production is confirmed by regular inspections required by the controlling state and local agencies, e.g., TX-RRC. The required API number display consists of 14 digits with 4 separator dashes which specifies the state, the county, the unique well identifier, 2 sidetrack digits and 2 event-sequence code characters. In case of a major emergency at a particular location, US federal agencies may also be involved under "Emergency Support Function #9".

In case of an accident or a terrorist attack on a remote gas-production facility, all emergency responders need a simple, quick, universal system to provide their crews with detailed, updated technical data on many important matters including: property control-ownership, health and safety risks, emergency-contact data for responsible managers/supervisors, building drawings, wiring and electrical power equipment locations, piping and control valves for fluids handled at the site, dangerous materials storage, etc.

In contrast to past practice of merely posting a minimal, API-compliant, flat metal ID sign near the well-head or pipeline access, the present warning system includes a active display of wind direction and velocity re the possible formation of a drift plume due to accidental release of hazardous gases. In addition, the apparatus confirms the visitor's identity, facilitates RFID data interchanges and enables secure weblinks to offsite data on selected critical factors pertinent to accidents at the site. The present invention is an integrated warning and security system for gas-production facilities which is also able to confirm the identity of each emergency responder prior to allowing wireless display, on a laptop computer, of information critical for a range of particular emergency-management scenarios.

A number of US Federal agencies, particularly DHS (Dept. of Homeland Security), are active in monitoring sites where dangerous materials or toxic chemicals are handled in order to assist in prevention of terror attacks and managing emergency responses in case of a situation which may threaten the health of regional populations. These agencies include: Department of Agriculture Department of Commerce, Department of Defense, Department of Health and Human Services, Department of the Interior, Department of Justice, Department of Labor, Department of Transportation, National Aeronautics and Space Administration and U.S. Agency for International Development.

The present invention is an apparatus and advanced system of information display adjacent the entrance of a site where large quantities of toxic fluids may be released in an accident or by terrorist attack. The displays of the system are configured to present just the appropriate information reasonable and specific to the particular visitor's purpose. For example a gas-production-reporting compliance inspector for a State Resources Commission would not be interested in complex modeling data on the probable extent and concentration profiles of a toxic-release plume under certain weather conditions—which would be critical for high-level FEMA managers. The following discloses apparatus and inherent-intrinsic use methods thereof along with a system of triage-ordered display sequences of action items tailored especially to meet the needs of visitors including: regular business calls, regulatory and law-enforcement site visitors as well as those of possible emergency responders.

Few other moments in recent history present such challenges for conventional signage and hazard displays. In the case of a facility drawing massive quantities of hydrocarbons from deep within the earth or ocean, the technology for fluid recovery has far outstretched the capability for dealing with massive accidental or intentional releases above ground. Effective emergency management depends upon having a response plan ahead of time which anticipates the probable scenarios and identifies and ranks the optimal responses. These were the missing links in dealing with the recent release of crude oil in the Gulf of Mexico.

FIGURES

FIG. 1 is a plan view of a typical oil or gas field site where hazardous substances may be released. The view shows: GPS coordinates, site features (buildings, tanks, equipment, not to scale), public roadway, private entry road, wind direction vector (typical prevailing direction), hypothetical H2S release point (circle w. cross), a stage in development of a hypothetical H2S plume (dashed outline, plan view, 10-ppm H2S concentration profile about 1 meter above the ground), a plume-dimension scale (meters measured approximately along its axis) and the security system of the present invention (airfoil pointing element adjacent entry road). The source for this hypothetical plume is a ruptured trans-critical fluid injection line. The escaping fluid components (mol. fractions) are: CO2 (0.51), H2S (0.45) and CH4 (0.04). The RFID tags of the security system are positioned with a clear field of view of a vehicle approaching along the public and private roadways. For this example, a visitor would be able to see the site features and the warning sign movements/displays from the public road.

Figure 2:
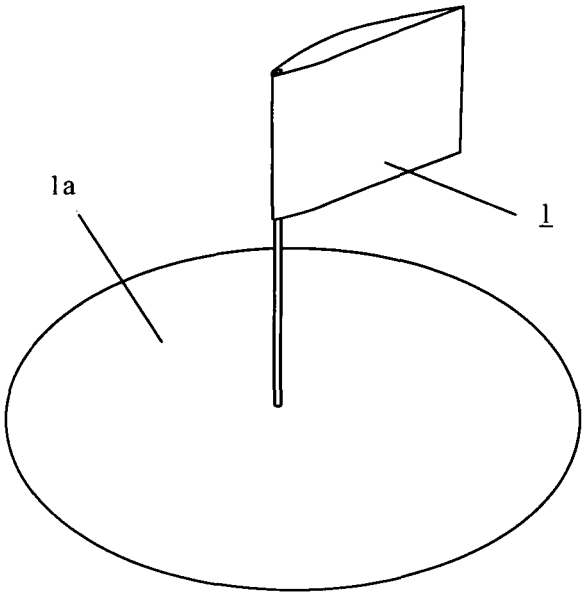
Figure 2:
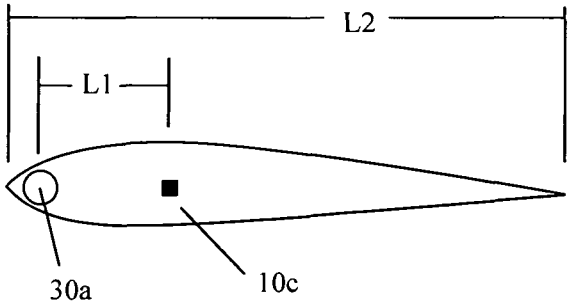

FIG. 2 shows an oblique view of the present security system on a mast about 1-2 meters above a cleared circle and a plan view of an embodiment. The lower portion shows detailed plan view of a pointing element with the pivot axis downstream of the leading edge. The center of lift of the airfoil for a gentle wind at a 5 degree angle of attack is shown as a filled square; this point falls about 0.2 times the chord downstream from the leading edge. The mast and its pivot axis is shown as a open circle immediately behind the leading edge. The center of lift and the pivot axis are separated by a lever-arm of length L1. The chord is indicated as L2 and this is also the overall length of this pointing element. This view illustrates an embodiment typical of Example 1.

Figure 3:
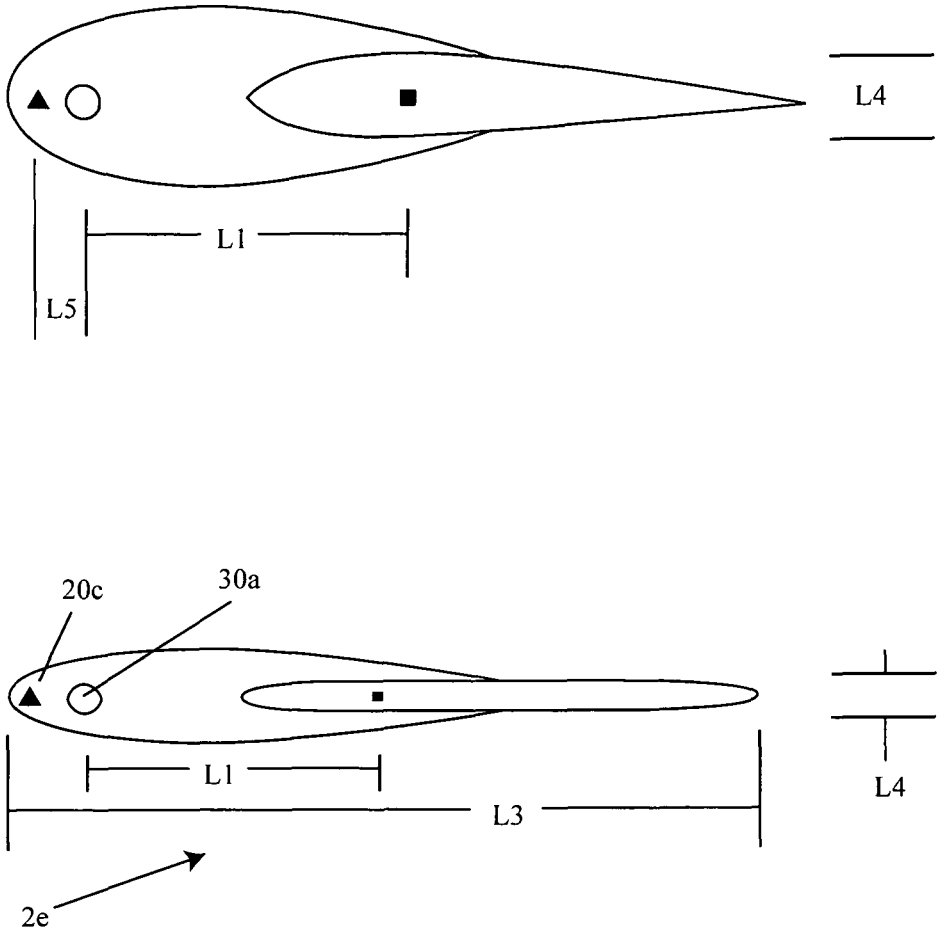

FIG. 3 shows two alternative pointing elements with lever-arms greater than 0.2*L2. The upper portion shows a plan view of an embodiment with a counterweight (filled triangle) fixed upstream of the mast and pivot axis (open circle) at a distance L5. The view also defines the airfoil camber, L4, and the angle of attack of a typical wind vector. The lower portion shows a plan view of an embodiment with a thin symmetric airfoil, i.e., low value of L4, including a counterweight; this view also defines the overall length of this pointing element, L3. This view illustrates an embodiment typical of Example 2.

Figure 4:
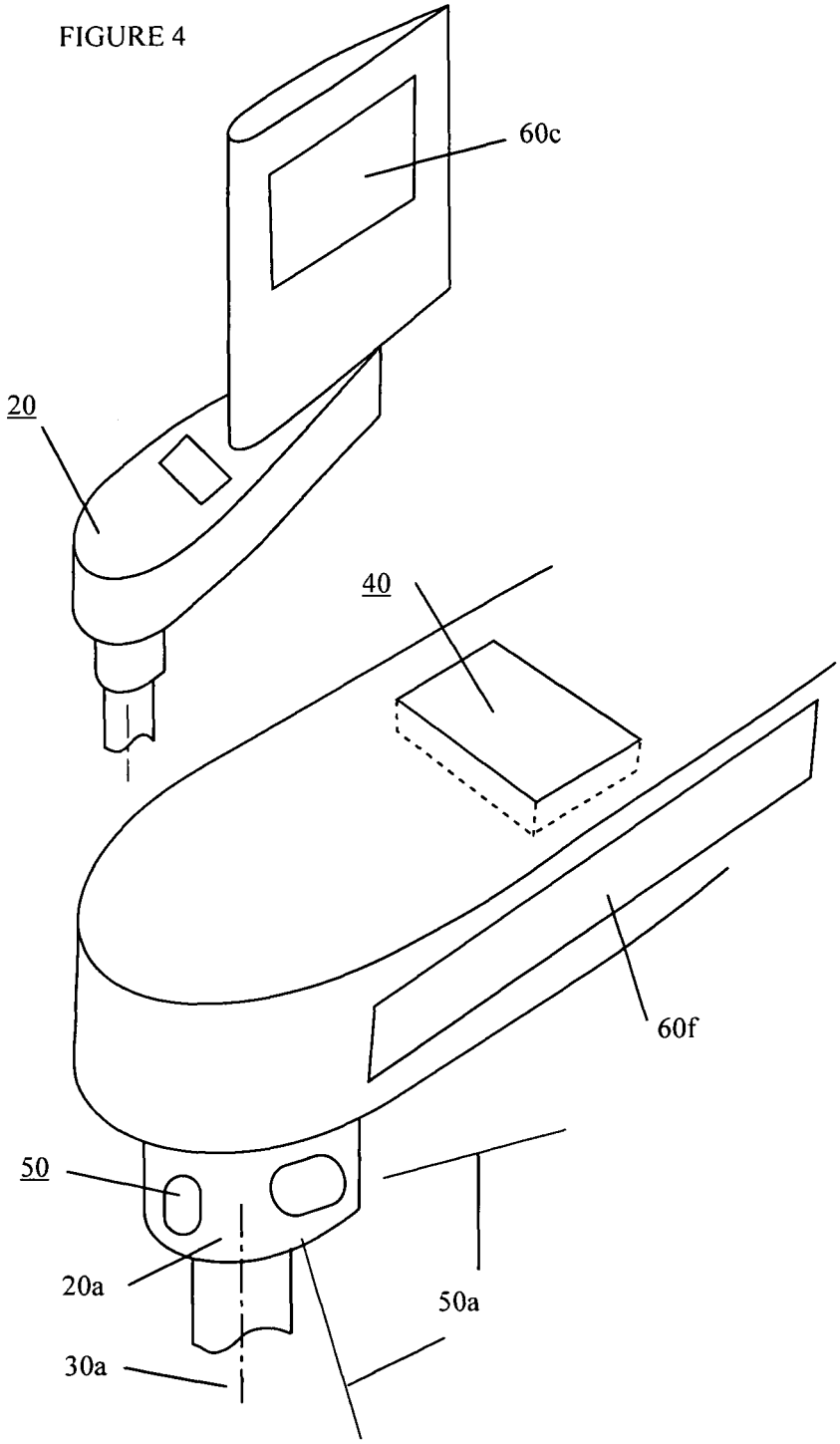

FIG. 4 shows schematic isometric views typical of Examples 2 and 3 and illustrates placement locations for traditional API signs (elongated rectangle outline with centerline) and hazard warnings (square-to-rectangular outline on "sail" surface) as well as "logical QR emblems" and RFID devices including optional circuit modules with a battery and related solar-photovoltaic components. The lower portion shows only the frontal portion of the "beam" and locations for interactive RFID tags and warning message placements.

Figure 5:
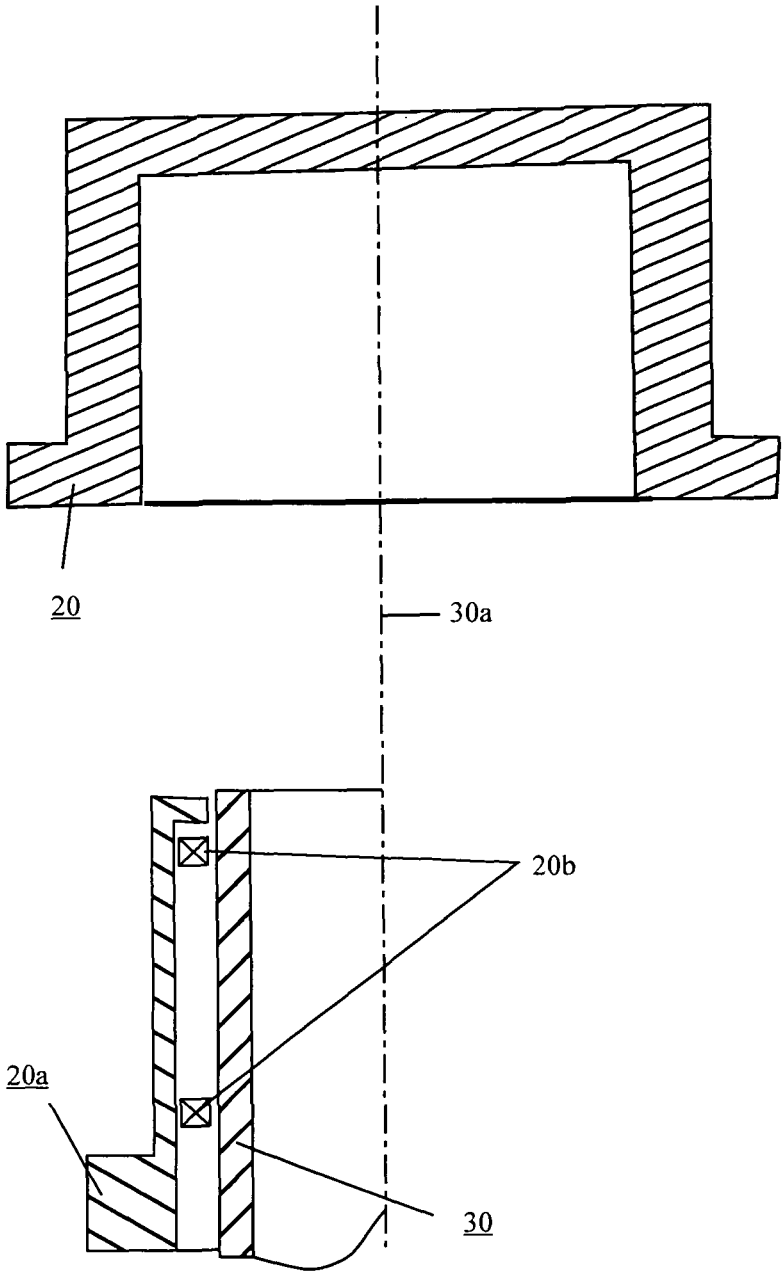
Figure 7:
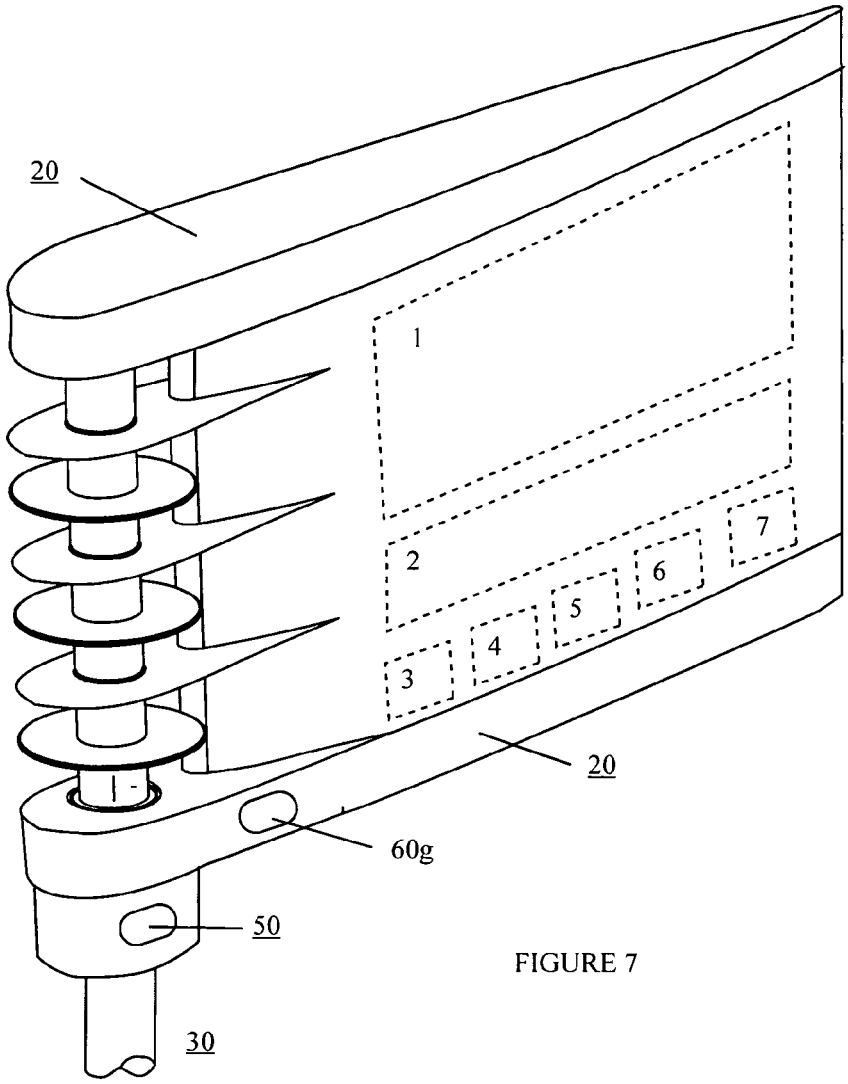

FIG. 5 shows a cut-away perspective view of the collar along with a cross-section of a lower-bearing collar, e.g., FIGS. 1 and 7, where the mast extends through the lower bearing set. The lower portion shows a cross-section view through the collar (cutting plane through and parallel to mast axis) and illustrates interior protective placement of low-friction bearings (shown as open squares with an "X") so that they are not exposed to environmental debris and precipitation. The mast is shown in this illustration as a thick-walled tube; however, a variety of other alternate sections are used to assure adequate mast stiffness and strength.

Figure 6:
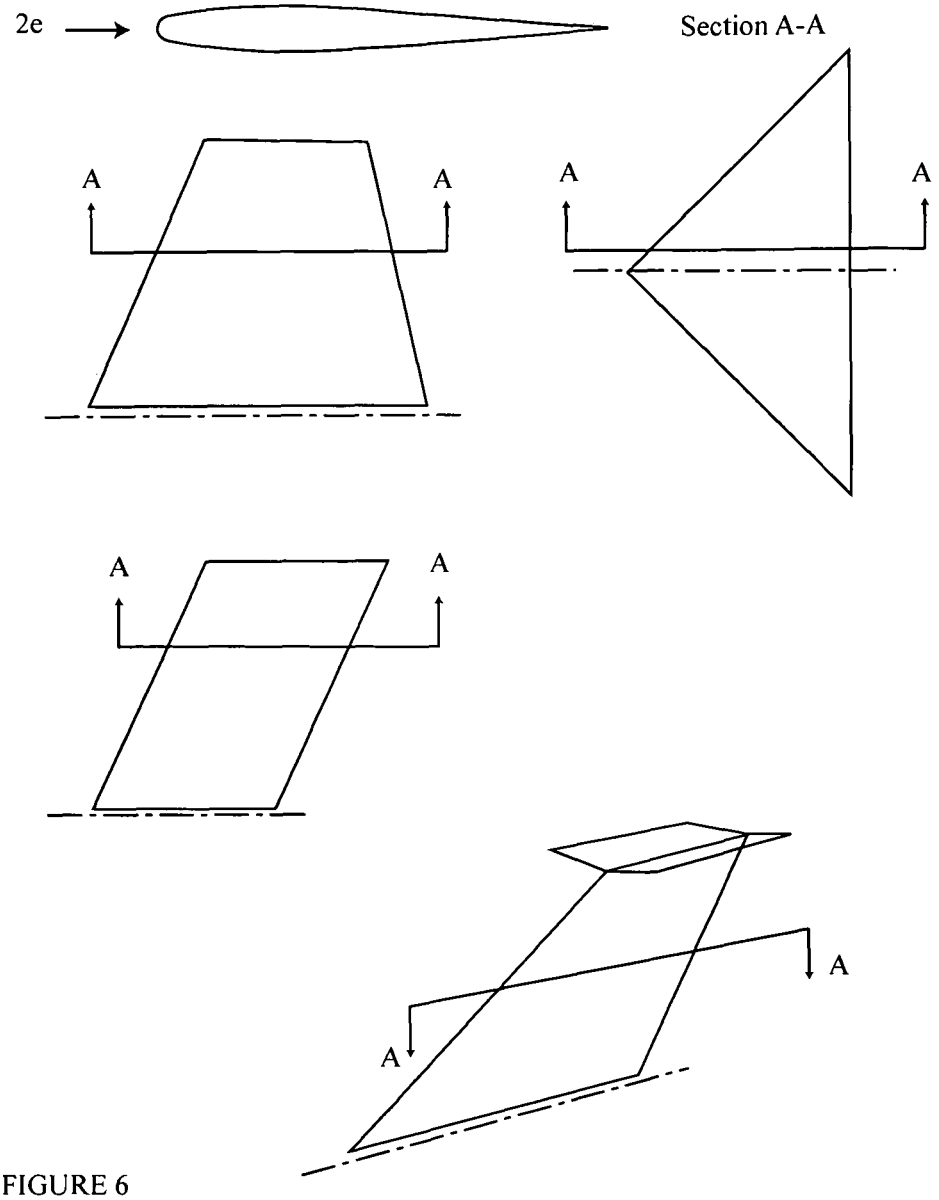

FIG. 6 shows several illustrative "sail" profile shapes. This view also shows the wind direction vector parallel to the plane of symmetry of the airfoil, which produces zero rotational moment. The triangular outline is shown mounted with equal areas above and below the center of the "beam". The other three profiles are shown extending above the "beam" centerline. Such profiles are used on Examples 2 and 3.

FIG. 7 is a schematic isometric view of an alternate embodiment somewhat similar to Example 1. In this case, the lever arm for pivoting is approximately doubled by extension of the "sail" root and tip portions forward as outboard support enclosures for the bearings. To minimize possible turbulence effects due to the mast being located a short distance ahead of the leading edge, this embodiment is fitted with an exemplary array of interpenetrating flow-straightening fins fixed to the mast and to the exterior of the leading edge surfaces. The leading-edge fins are provided with holes for free rotation around the mast. The dashed outlines indicate alternative graphics placed on the "sail". This figure illustrates typical placement of traditional and "logical QR emblems" on the main sail faces; see items 3-7. This figure illustrates a typical placement of API identification number; see item 2. This figure illustrates alternative placements of RFID tags; see rounded rectangles on lower "sail" edge and bearing collar. The area marked 1 is adapted to accept a typical toxic poster insert of approved colors, text and size. The area marked 2 is adapted to accept an industry-specific ID poster insert of approved colors, text and size. The areas marked 3-7 are adapted to accept agency or purpose specific "logical QR emblems" (separate and different, compliant with ISO-18004). The "sail" characteristics for this embodiment are: span (400-600 mm), chord (400-600 mm) and camber (20-60 mm). Anti-friction bearings for this embodiment are illustrated in FIG. 5.

Figure 8:
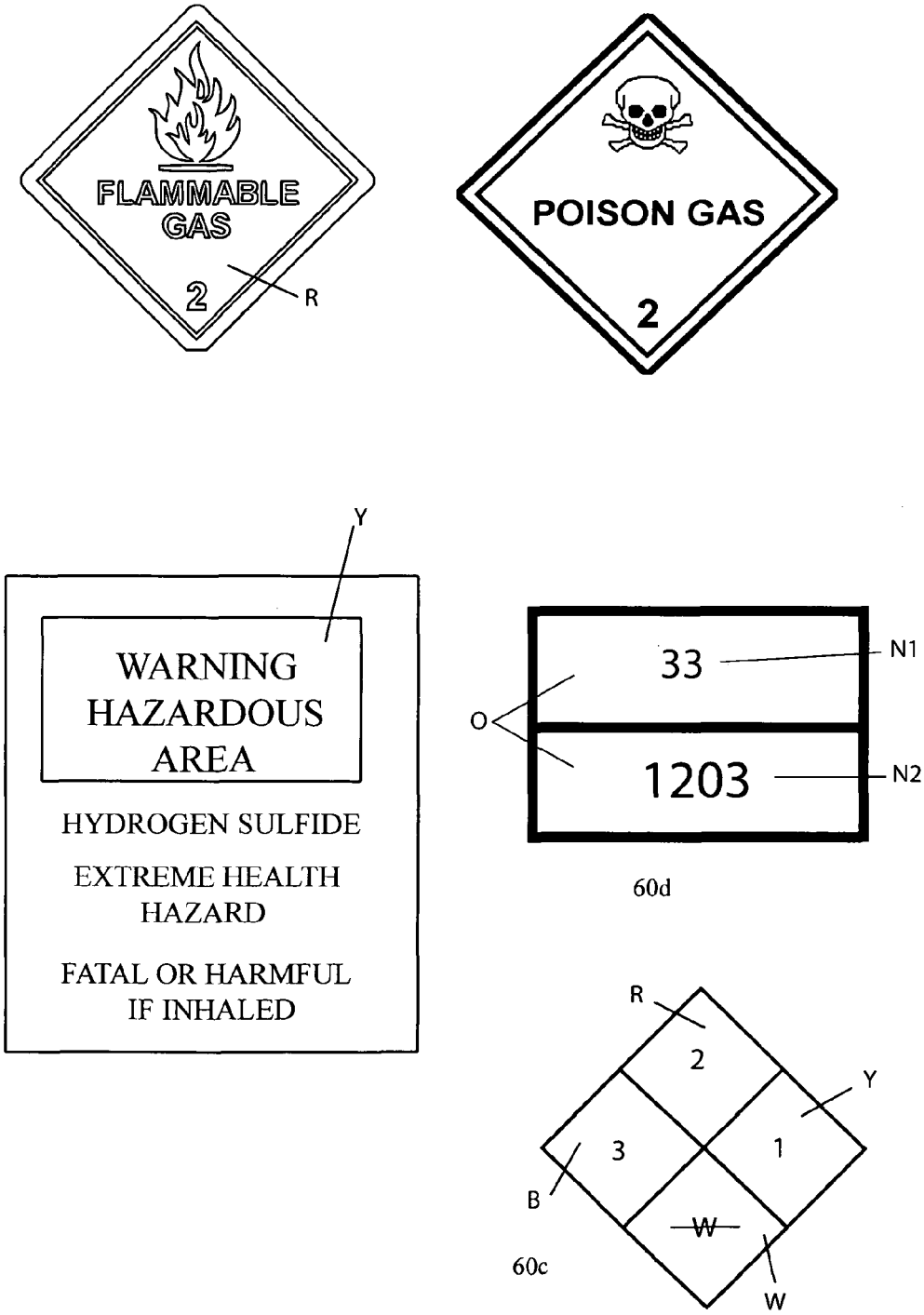

FIG. 8 shows five typical, traditional risk-warning images indicating different hazards from toxic-poisonous to flammable-explosive classifications. Such images form the user-friendly link of the present "logical QR emblems" when they are superimposed onto the basic data-matrix cluster. While these known graphics illustrate a few warning classes, other graphics which are also used in the present invention include: logo symbols of a particular government agency/business or ideograph symbols of selected professions/activities relevant to the site.

Figure 8B:
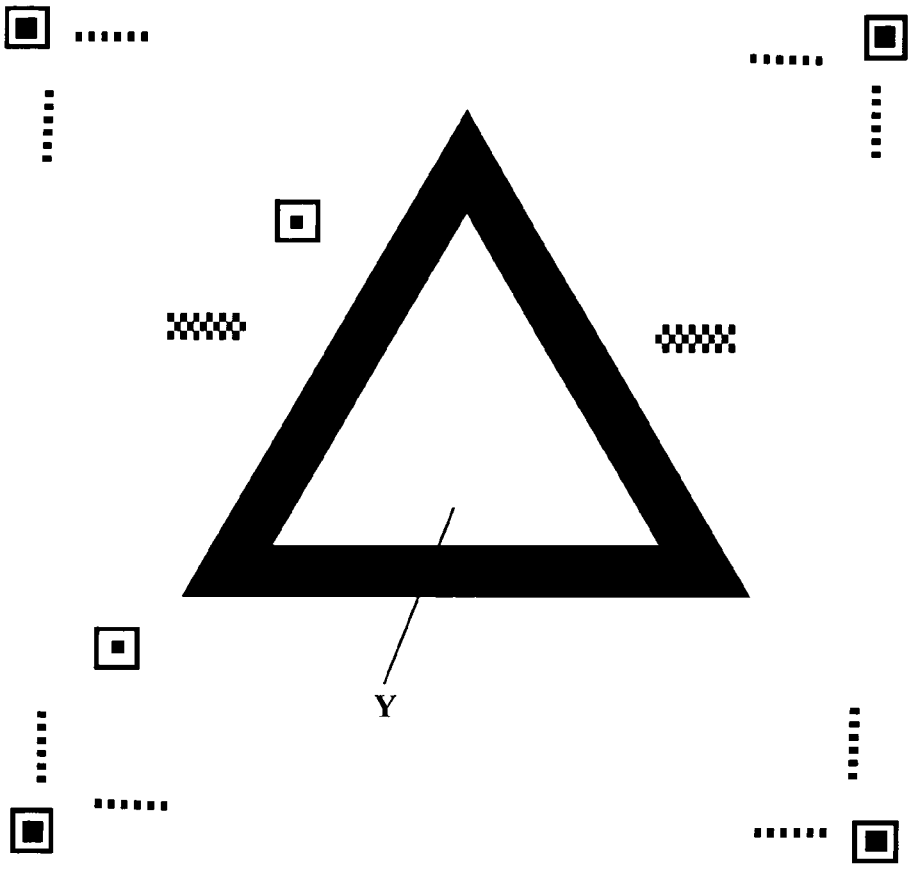
Figure 8B:
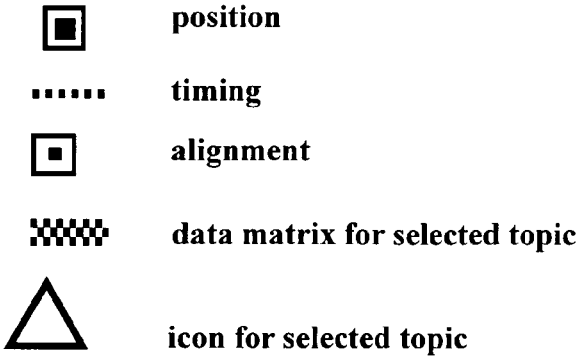

FIG. 8*b* illustrates how the basic components of the Denso-type QR code are meshed with the superimposed traditional, specific-class warning image. The legend (below) identifies each feature.

TABLE 1

Indicia for Elements and Features

| Indicia | Feature |
|---|---|
| 1 | wind-responsive warning sign |
| 1a | prepared ground area around sign |
| 2 | site |
| 2a | release point |
| 2b | site structures |
| 2c | site enclosure |
| 2d | public access portal |
| 2e | wind vector, prevailing direction |
| 2f | toxic zone ~300 ppm H2S |
| 2g | toxic plume outline ~10 ppm H2S |
| 2h | toxic plume length, meters |
| 10 | airfoil element |
| 10a | airfoil chord |
| L4 | aifoil thickness, camber |
| 10c | center of pressure |
| 20 | support arm(s) |
| L2 | total length = chord |
| L3 | beam length > chord |
| L5 | counterweight offset |
| 20a | collar |
| 20b | low-friction bearings |
| 20c | counterweight |
| 30 | mast |
| 30a | mast axis, pivot axis |
| LI | mast axis offset re center of pressure |
| 40 | electronic components |
| 50 | RFID devices |
| 50a | ~90 deg. RFID reading field |
| 60 | signs-displays-site ID |
| 60a | flammable |

TABLE 1-continued

| Indicia for Elements and Features | |
|---|---|
| Indicia | Feature |
| 60b | H2S-toxic |
| 60c | inserted warning sign |
| 60d | EU- EINECS warning |
| 60e | NFPA-RTK warning |
| 60f | API ID sign |
| 60g | any QR emblems |

TABLE 2

| Indicia for Warning Signs | |
|---|---|
| Field Colors | |
| B | blue |
| O | orange |
| R | red |
| W | white |
| Y | yellow |
| Field | |
| 1 | instability |
| 2 | flash temp., deg. F |
| 3 | health hazard |
| 4 | specific hazard |
| N1 | EINECS hazard class |
| N1 = 33 | EINECS code = highly inflammable |
| N2 | EINECS substance |
| N2 = 1203 | gasoline |

Windvane Apparatus

Typical Production-Site Layout

FIG. 1 illustrates a layout of a typical gas-well site; and depicts placement of the warning sign of this invention downwind of a hypothetical release of H2S.

Computer Models of Toxic Plumes and Rate of Development

Computer models are used to estimate the spatial dispersion, under specific local wind patterns, of a toxic-gas release into the local environment. The classic Pasquill-Gofford-Turner (PGT) formalism is frequently used for small releases. The Gaussian, ALOHA, CAMEO, DEGADIS and SLAB models are used to estimate downwind and downgradient profiles of gases, such as H2S, being released in large amounts over significant periods of time. To predict a reasonable distance and direction for placement of a warning sign outside a probable lethal zone, these and other model approaches may be further customized to fit the unique features of a site. Examination of previous models is helpful to rank-order the numerous factors including: quantities and temporal factors for toxic components being released, temperature, humidity, barometer, molecular weights of toxic gases, wind direction vectors, wind velocity-gust patterns and possible vertical_horizontal jet effects at the release or rupture point.

The present invention is believed to be a pioneering effort in developing a system approach to "warning sign optimization", i.e., in recognizing the importance of: (a) the placement of the mast relative to site buildings, structures and topology, (b) the reading-distance and orientation of RFID devices relative to the visitor entry path or vehicle road and (c) anticipating that each class of visitor will need immediate access only to limited, task-specific data and not every data record which may have been accumulated for the particular site.

Optimal Location/Orientation of Warning Sign and IT Elements

For illustration, one typical model for H2S release, (22 000 ppm H2S concentration from a 100-mm pipeline) indicates that the "nominal PGT safe radius", i.e., 100 down to 10 ppm gradient zone at ground level, should fall at a downwind distance in the range 60-100 m from the release. The emergency-response plan required for each site should include current maps and data (tables, graphs and videos) showing the 2D and 3D displays of size and toxic-concentration profiles of a probable plume, assuming worst-case atmospheric conditions, especially seasonal and monthly prevailing wind vectors. Factored together with recent experiences for handling emergency situations in the specific region, each site model will define the distance vector to "closest safe position zones" for the various warning displays of the present invention.

Aerodynamic Features

In the following the pivoted, airfoil-like pointing element of the present invention is referred to as a "sail" to avoid wordiness; this usage is put in quotes and means the pointing element disclosed in detail below.

Wind Direction Sensing

The direction-sensing characteristics of alternative embodiments of the present invention have been tested by preliminary experiments and found to be appropriate for establishing the visual wind-direction vector to an accuracy of about 1-2 of the 32 cardinal points of the compass. The long-term operational reliability of pointing is, however, dependent upon: (a) keeping the "sail" and its pivot support or "beam" free of interference such as wind-borne debris or ice, (b) maintaining structural and mechanical integrity of the "sail", "beam" and mast and (c) maintaining verification records of testing at regular times of the indicated direction and comparison with reliable data from a portable calibration device brought to the site.

Wind Velocity Sensing

Because wind velocity is more difficult to measure accurately than direction, embodiments of the present invention which include velocity-measuring options must be monitored by regular calibration records to verify accuracy indications of drift or premature failure.

For some wireless-networked installations, a toxic release will trigger local alarms and a site visitor who uses broadband to access remote databases as from his vehicle on the entry road will already be aware that a toxic release has happened.

For other sites, a first-time visitor who uses a smartphone to read the QR code display on the present warning sign and link into the web will be aware of the possibility of a release of specific toxics. He will also be presented with simple safety information including a basic map display which shows the distance and direction from his location at the entrance to possible toxic release points.

The most critical visitor may be the worker responsible for monitoring or maintaining production equipment at a large and extremely remote site without modern alarms and wireless communications. For some such situations the important vulnerable structures may not be visible, even using binoculars, from the entrance. In such a case, the warning-sign indications of wind vector and velocity of the present sign should then be added to instant readings from a reliable portable device capable of measuring selected toxic gas concentrations. Such equipment would be routinely carried and instantly available under workplace health and safety rules.

Network Features

Because certain critical networks in typical Western countries have always been controlled by physical valves (public water systems) and independent trackage (public rail transport systems), they have usually been viewed as separate, widely-dispersed resources which are not well adapted to computer control nor logically exploitable by a typical cyber attack. Contrarywise, large portions of the electrical power grid along with major voice and data communications networks have been controlled by automated operations research methods from their early stages. By simple electronic logic over the web, virtually all public infrastructure is now increasingly the target of State-sponsored cyber attacks. The internet with its massive optical networks is perhaps the most vulnerable of all critical national resources. It is a fact in the 21st century that virtually all such networks can now be crippled, destroyed or plundered by sophisticated and relentless cyber attack.

Included in the following are the essential technical details to explain and enable the present invention. Although many specific details are set forth below to provide a clear understanding of the present invention, not all such specific or particular elements are needed to practice our invention. Operations and components well known to one skilled in the art are not described in detail.

The terms "one embodiment" or "an embodiment" as used below mean that a particular feature, structure, operation, or other characteristic described in connection with the embodiment may be included in at least one implementation of the invention. However, the appearance of the phrase "in one embodiment" in various places in the specification does not necessarily refer to the same embodiment.

Alternative embodiments of the present invention include apparatus, systems and methods for authenticating the identity, authority and specific project purpose of a particular site visitor or agency representative. These safeguards can be extremely effective in denying access to vandals, scammers and terrorists.

The apparatus and methods of use thereof disclosed below can facilitate rapid, secure verification of the authenticity of identification devices, e.g., text passwords, hologram, or other symbol, currently being used by all possible classes of legitimate site visitors (business, regulatory, emergency, law enforcement, etc.). For example, a voice device may be used to speak required authentication code in a particular designated language or a touch-pad display may be used to input text, special characters or icons.

RFID Tags

As used herein, the nomenclature "RFID" means radio frequency identification of previously-tagged things, i.e., any item upon which a small, low-cost tag chip can be attached, injected or mounted. The "tag" device contains a transponder along with an antenna tuned for a particular frequency by which it can be interrogated using a reader. The three basic RFID coupling technics are: backscattering, capacitive and inductive.

Analogous to operation of a simple dipole radio antenna, a portion of the "read" signal arriving onto the tag is reflected backwards and this "backscattered radiation" contains the coded messages developed from the reading interaction. Over short reading distances, enough power can be transmitted into the tag to operate its low-current internal circuits. Frequently, a directional coupler is also used to facilitate easy separation of the returned signal. Many backscattering devices operate in the UHF frequency range (800-950 MHz) and the upper limit for frequency is typically in the SHF range (2.4-5.8 GHz). RFID systems based on long-range backscattering can operate over distances in the range 1-10 meters.

For example, capacitive coupling, is used in so-called "smart card" devices compliant with ISO-10536; these connect into the information network at close range using the electrodes of the capacitor.

Inductive coupling systems, or "vicinity cards" according to ISO-15693, operate by virtue of a near-field magnetic-induction linkage between the tags and a reader; such systems typically operate at frequencies in the range below 135 kHz or at about 13.6 MHz.

The present invention incorporates one or more known commercial, customized and or experimental RFID devices/systems as links into the critical information networks which serve a variety of security, management and regulatory needs within the oil and gas production industry. These alternative protocols-interfaces include: EPCglobal (ISO-IEC 18000), IPv6 language, directional tag interrogation using "guard signals", ActiveWave controls_tracking, Active and Passive tags, along with secure middleware (e.g., resistant to SQL injection attacks). The routine matters of safety inspections, production reporting/confirmation, regulatory checks, etc., can all be automatically and securely recorded and reported by means of wireless web links between the reader assigned to a specific field agent and the particular agency he represents. Moreover, the identity and latest authorization level of each agent who enters the site is re-confirmed and time stamped into a separate database record for every visit.

Concerning security of all types of data about a critical site, the present invention discloses apparatus integration of a read-only RFID tag with a unique random-number identifier. By this technique, the physical tag may be "killed" or completely removed from the site and/or the unique number can also be removed from the several related databases. This method, which is possible under Class 0 or a special variant of Gen-2, avoids the multiple security vulnerabilities of typical Gen-2 tags.

For first-responders in an emergency, the present system of immediate linking into detailed and up-to-date and concise information relevant to particular risks at the specific site is uniquely valuable. This advanced system provides the emergency worker many critical and profound advantages over the few characters of information displayed on the typical required API well-identification sign along with a possible "Toxic" or "H2S Warning" sign hanging by a single rusty nail on a nearby fence post.

Lateral surfaces of the mast, "beam" and collar are provided with an array of predetermined locations for secure attachment of active or passive RFID tags; such devices and flush-mounted circuit packages with batteries and photovoltaic cells (into predetermined recesses) are added during original assembly or, alternatively, may be mounted as a field modification.

QR Codes

As used herein, the nomenclature "QR codes" means information handling technology for automatic identification and data capture according to ISO/IEC 18004, using QR Code 2005 symbology (2D graphic symbols). These standards cover symbology, data character encoding methods, symbol formats, dimensional characteristics, error-correction rules, reference decoding algorithms, production quality requirements and user-selectable application parameters. At present there are approximately 40 variants of 2D codes, each with certain advantages for a few specific-use parameters. The Open Mobile Alliance provides update white papers on future research areas for functional improvements of the general QR technology. A topic under active development is the QRME code which captures information of when and where the image was scanned. Such graphics are particularly valuable for critical sites and these technologies are being added as a feature of the present security systems.

Typical current QR codes contain about 2900 bytes of information (roughly 4300 ASCII characters, including error-compensation for dirt/scratches). The symbols are open standard and web linked; they are also inexpensive and no special equipment is needed to access them. At present, the most common use method for the technic is placement of a postage-stamp-sized graphic in print media; the symbol can then be imaged and interpreted by smartphone internal cameras. The phone automatically connects the user to a predetermined website and displays selected information, typically consumer product features or specifications.

Because QR codes are widely used in Asia, there are many variations of the original Denso standards, i.e., about 70 distinct varieties are known (in April 2011), about 10-20 are widely used. Each code includes the following key elements: version (numbered 1-40, 4 modules (each higher version contains 4 additional data-capacity modules), Kanji and Kana characters, format, Reed-Solomon error correction (4 levels, L, M, Q and H) and required pattern markers (position, alignment, timing).

The present invention provides selected unique QR elements to facilitate site visit activities; these include instantly-recognizable activity-related symbols or icons superimposed on the basic information matrix. In the case of emergency responders, traditional icons for each type of hazards are visible in the QR code matrix arrays displayed, e.g., fire, toxics, biohazards, explosion, pollution, ionizing-radiation and terrorism. The nomenclature "logical QR emblem", as used in the following, means addition of a functional, logical or topical icon into any variant 2D code such as, but not limited to, QR, DataMatrix, MaxiCode or PDF417. FIG. 8*b* illustrates a specific example of a logical QR emblem—for the selected topic "general warning"—as might be used on signs of the present security system.

Lateral-facing surfaces of the "sail", mast, "beam" and collar offer an array of predetermined locations for secure attachment of QR code icons sized for easy access by a visitor's smartphone; additional illumination might be needed from a flash accessory during evening hours. Although these images are most economically added during original assembly, they may also be applied as a field repair/modification/addition.

Advanced Warning Signage

30 CFR 250.490, which defines warning signs and safety practices for gas wells in the outer continental shelf, requires high-visibility yellow signs with black lettering. The required letter height for the main messages, i.e., "Danger; Poisonous Gas; Hydrogen Sulfide" is 305 mm. The required letter height for the secondary messages, i.e., "Do not approach if red flag is flying; Do not approach if red lights are flashing" is 178 mm. Basically, the required sign displays 4 lines of about 40 characters each, or about 160 characters total. Typical layout of compliant sign boards might require dimensions of approx 4×6 m, far larger than contemplated by prototypes of the present invention which were originally intended for land use. Careful review of commercial warning-sign catalogs (April 2011) revealed that typical producers do not offer anything larger than 610×914 mm and off-the-shelf layouts show different and/or re-configured text.

At present, advanced RFID tags now becoming available and allowable can replace traditional large-text, visible-warning signs. For example, the Omni-ID Ultra passive tag can be read at ranges of 35 meters (860-960 MHz). Of course, special RFID readers now in use by military and State-security agencies can operate at much higher power and can therefore read such tags at significantly longer ranges. Moreover, because RFID and QR codes provide reader displays of much more than 160 characters, it is possible to give the warning message or data in additional languages or in more detail.

Warning signs of the present invention are intended for use in critical applications where district power may be compromised or completely lost during an emergency. So that the warnings are clearly visible during such an event, the present signs must exhibit efficient retroreflectivity properties and be designed for instant understanding by emergency responders in languages common to the region. Therefore, advanced materials, fonts and sign-making techniques must be used. Preliminary tests, using prototype sails with weather-tolerant, silk-screened non-reflective images about 300-400 mm in size, were made using traditional fonts, kerning, colors and layout; these proved to be highly visible warnings during daylight. For actual product embodiments, is envisioned that state-of-the-art materials such as microprismatic sheet of ASTM Types I, II, III, IV, VIII, IX and XI are used; these types include both glass-beads and microprisms. ASTM Standard D4956 indicates the particular properties and test methods needed to qualify materials used for the present warning signs. Depending upon specific needs of the site, the reflective letters may be produced by one or more known methods including: cut-outs, demountable separate letters on aluminum sheet stock, negative silk screen, positive silk screen, and overlay film. To assure instant readability and understanding of the reflective warning words, proven, advanced typefaces such as ClearviewHwy, or improved variants, are used. For warning-sign applications in States where multiple languages are in common use, there are now versions of ClearviewHwy with special characters, e.g., Latin, French, German, Nordic, Greek and Cyrillic. The present invention offers—for the first time—rational, perception-tested, retroreflective warning fonts, colors and symbols to convey critical emergency information with minimal chance of confusion or misunderstanding. Ideally, such modern retroreflective fonts with exceptional visibility and readability can be introduced, at least on a provisional basis, into the signage displays illustrated in FIG. 7.

To assure that QR codes on the present invention are instantly and accurately sensed by smartphones in low light levels or in darkness using improvised lighting devices, the graphics of the present invention are configured to include high-resolution, retroreflective QR images based upon the principles noted above for warning text and icons. One advanced technology which is applicable is the use of pigments which are reflective in the near-infrared wavelength range (just outside the visible). For maximum tolerance of reading errors which are to be expected under emergency conditions, it is ideal to provide the present system with advanced QR readers which utilize shape-based recognition algorithms. The pattern-reading process for 2D image involves 5 steps, i.e., edge detect, shape detect, find control bar, confirm orientation and bit density and finally determining the characters/value. Using such methods, an advanced, technique-error-tolerant reader is a significant benefit to emergency responders for warning-sign QR codes.

Site visitors with a cell phone may easily connect with significant data including:

Agency or company contact information

Telephone or web access to website or social network

Access a data feed such as RSS, SMS or other

Access an email address or appointment calendar application

Access selected location data including GPS and address.

Database SQL Queries and Displays

As used herein, the nomenclature "SQL queries" means the particular vocabulary of technical terms, commands and abbreviations used by a IT specialist to interact with an indexed relational database on an expedited basis.

One unique aspect of the present invention is to use upscaled 2D symbols, approximately 100-300 mm in size, to provide an immediate link to a unique, secure activity-specific website. For example, an emergency-responder volunteer fireman needs immediate access to the complete, updated hazardous-materials inventory for the site along with the emergency-plan list of critical action items derived from material safety data (MSDS sheets) and other relevant technical data. The reader-devices provided to such crews would include a bright display (easily readable even in full sunlight) and adult-sized input keys to facilitate ongoing SQL-type web interactions by the crew leader with more than one remote database to validate his identity and to obtain particular, situation-related sensitive data without delays.

Another alternative methodology would be to provide at least one encrypted symbol somewhere on the site signage which provides the emergency-crew leader with additional data which must be combined with other secret passwords (known only to the crew which identify a particular responding agency and type of call).

Mechanical Structures

Mast and Pivot Axis

As used herein, the nomenclature "mast" means a rigid, member: (a) permanently fixed into the earth, (b) oriented perpendicular to the immediate surface and (c) exposed on all sides to receive direct, undeflected natural airflow from all directions. Ideally, the mast is located in the center of an open and reasonably leveled area.

The function of the mast is to provide a vertical pivot axis for the "sail". According to different embodiments of the present invention, the mast may be either: (a) enclosed within or (b) external to the "sail". For external cases in which the mast stands in the flow path ahead of the "sail", the mast should be made to a stiff cross-section, using high-strength, high-modulus materials. Since it is upstream of the incident flow in these cases, its diameter should be the minimum required for mechanical stability and its external surface should be a smooth cylinder.

The most-sensitive embodiment of the present invention re pointing the wind direction under quiescent conditions is configured with the mast extending vertically from the ground and into the "beam", but not projecting upward above it, whereby the flow may possibly be altered upstream of an active "sail" portion.

For embodiments with any mast portion standing upstream of the "sail", possible direction and velocity errors resulting from expected flow anomalies of a 25 mm mast located 10-20 diameters upstream are minimal under Beaufort 1-3 conditions. For such embodiments, optional flow guides are disclosed for removable attachment or permanent mounting on the mast surface or on the surface of the leading-edge portion of the "sail".

Bearing Support or "Beam"

As used herein, the nomenclature "beam" means the supporting structure which couples the "sail" to the bearings upon which it is pivoted. For short lever-arm versions, the "beam" is integrated into the upper and lower "sail" edges. For longer lever-arm versions, the exterior "beam" is coupled to the pivot axis upstream of the sail. In the latter case, the "beam" is an elongated, sealed, hollow, box-like enclosure consisting essentially of two mating portions and provided with a socket on its lower face to receive a bearing-collar for low-friction rotational attachment of the beam upon the upper end of the mast. The sealed, weather-resistant "beam" shell may be formed as a unitary tube or as gasket-sealed, mating sections, e.g., top-bottom, left-right and proximal-distal. These shell elements may be formed of metals, alloys, polymers or other composite materials suitable for long-term exposure to extremes of weather.

The "beam" is also provided with secure mountings for: (a) at least one "sail" element to the distal portion, (b) at least one counterweight of selected mass onto or within the proximal portion, (c) an internal circuit package including a battery, memory store, firmware, antenna, and selected other electronic elements. The "beam" may include an optional upward-facing photovoltaic device for converting solar radiation into an electric current sufficient to recharge internal storage cells connected to the circuit package and used to power various features of the system. The "beam" may also be provided with optional exterior fittings for secure longitudinal attachment of at least one strip bearing special warning data or other information.

Pivot Bearings

As used herein the nomenclature "bearings" or "pivot bearings" means an assembly of two or more anti-friction bearings which allow free rotational movements of the "beam" about the mast axis responsive to a light breeze and under extremes of precipitation and temperature. Test data indicates that sealed ball bearings intended for instrumentation are suitable for this application; alternatively, ceramic ball bearings as used on racing bicycles may also be used. FIG. 5 illustrates alternative bearing configurations.

Pointing Elements or "Sail"

As used herein the nomenclature "sail" means a stiff, lightweight, symmetric airfoil panel having a smooth exterior surface attached to support structure for bearings, the plane of symmetry of the "sail" panel being generally vertical and aligned along the "beam" axis. The root of the "sail" is that portion connected to and adjacent to an external "beam"; the tip of the "sail" is the outboard portion farthest from an external "beam". The aerodynamic features of the "sail" of the present invention are conveniently characterized using airfoil terms. The chord is the characteristic width dimension parallel to the "beam" axis or airflow direction. For a non-rectangular polygon outline shape, the "chord" is the arithmetic average between the root and tip. The "sail" camber is the characteristic thickness dimension measured perpendicular to the plane of symmetry. The "span" of the "sail" is the characteristic length dimension measured from the root to the tip or top to bottom for a sail-only or integrated "beam" version.

The chordwise cross-section of the "sail" is a typical known symmetric airfoil such as naca-0018 (National Advisory Committee on Aeronautics). Although such high-lift airfoils provide max. lift and related improved pointing accuracy-stability under Beaufort-1 conditions, other foils may be used. For example, a stiff, thin, flat plate with rounded leading and trailing edges provides sufficient sensitivity, accuracy and steadiness for most conditions; similarly, variants of Kutta-Joukowski forms are also appropriate.

Typically the "sail" is formed as mating halves of durable polymer profile shapes which are stable against extreme temperatures, ice formation and light impacts with birds or windborne debris. When the plane of symmetry of the "sail" is not parallel with local air flow direction, a lift force is generated; this moment acts to move the "beam" and "sail" into the alignment with the instantaneous flow direction vector. The "sail" may be formed integral with the "beam", e.g., injection molded as a single part, or prepared as a separate insert attachable by known fasteners or by known bonding methods. To minimize "sail" mass it may be hollow or filled with known lightweight structural foam materials. Indeed, the "sail" may be formed as a composite of suitable low-density materials, including wood.

Alternatively, the "sail" and "beam" may be functionally coalesced into a single "sail"-like element. Such embodiments may be formed by joining one or more curved sheets of thin material into a symmetric airfoil configuration. In such an embodiment, a internal frame of appropriate strength and stiffness supports the skin elements and the bearings which allow rotation about the mast. Optionally, lightweight stiffening cores and counterweights may also be added within or inside the "sail" surfaces. For sail-only or integrated beam embodiments, flat sheets forming the lateral surfaces are attached to shape-defining internal formers, e.g., "wing ribs".

Ideally, the lift force generated by a local air current at a velocity of 0.5 meter/sec and a 5-degree angle of attack to the plane of the "sail" will produce an immediate, corresponding rotation response of the "beam". The lift is resisted by stick-slip rotational friction in the bearings which allow the "sail" to pivot. Given a particular "sail" airfoil, area and angle of attack along with specific mechanical factors, there is a minimum or threshold air velocity which will be needed to cause its incremental rotation into alignment.

For the present invention, each particular alternative "sail" configuration involves optimization of multiple factors including: signage area and the lift-force threshold. Generally, a traditional, visible personnel warning sign is about 400 mm square; for some cases, this may be a typical lower limit of "sail" area.

Indeed, for the present invention, "sail" parameters may be optimized for the expected atmospheric dispersion plume of particular toxic gas mixtures under specific local worst-case environmental conditions. For example, accidental release of toxic gas molecules which are more dense than the oxygen or nitrogen into cold, quiescent air may represent just such a situation. Under such conditions, the lift force of the "sail" must be sufficient to cause it to point along the drift-propagation vector of a developing toxic plume. Local prevailing wind velocity and direction inputs into known dispersion-plume models for specific toxic molecules are thus used to predict such situations with reasonable accuracy.

Under moderate air velocity conditions, vortex shedding from the outboard tip of a "sail" profile may cause mechanical vibrations; similarly, increased form drag may impose increased bearing loads and thereby slow "beam" response. Together, these effects may result in increased bearing friction or cause their premature wearout. Known winglet technics are used to minimize such effects.

Air-Velocity Sensors

As used herein the nomenclature "air-velocity sensor" means a selected flow-rate sensor employing a known technology including: mechanical paddles/blades, an electronic force sensor, an electrically-heated wire, etc., which are reliable for accurate sensing of continuous breezes or instantaneous local air gusts.

An air-velocity sensor may be added to a predetermined external or internal mounting socket on the present invention during original assembly; the particular mounting point/orientation are chosen to provide sufficient velocity-sensing exposure to local air currents without compromise of the basic pointing capabilities. Selected external sensors are also added to predetermined attachment sockets as a field modification/repair/addition.

"Sail-only" embodiments of the present invention include internal structure provisions for optional integration of an appropriate internal flow-thru channel. This offers some protection against problems due to accumulation of precipitation or solid-particulate debris during operation. If desired, this feature is installed during original assembly.

For the present invention, the range of air velocity to be indicated is 0 to 30 m/s and the active sensing elements must be robust enough to function in temperature extremes, solid precipitation and to survive wind speeds up to about 37 m/s.

Ideally, the sensor device is adapted to link, using one or more active RFID tags, along with a solar-rechargeable power battery, into a weather-data network. This link would provide a site visitor with an instantaneous signal or display on his portable tag reader device, which indicates the air-velocity vector currently being measured at the closest reporting station.

Alternate Configurations of Mechanical Elements

The warning sign of the present invention includes an aerodynamic subassembly for wind-direction pointing, i.e., the "sail", which is mounted for free rotation on a low-friction bearings fixed to a vertical mast placed for unimpeded exposure to local wind currents.

The preferred embodiment of the warning sign of the present invention incorporates a variable-length, optimizable lever-arm element which couples the center of pressure of a known symmetric airfoil, which is scalable in its size, shape and offset distance, to the pivot axis of the mounting bearing. The lever-length-optimizing element is the structure or "beam" which connects the "sail's" center of lift to the bearings and mast which support it. The lever arm length, L1 (see FIGS. 2 and 3), ranges from 0.2 to 4 times the average chord of the "sail". The choice of an optimal length for a individual situation involves weighing of factors such as original cost, required pointing accuracy and expenses of ongoing maintenance against possible damage due to local environmental effects such as dust, debris, wildlife and corrosive gases. Many familiar toxic gases are heavier than air and releases present special challenges toward safety of first responders and therefore dictate the number and size of warnings.

Scalability of the several "sail" form factors is a critical feature of the present invention because it controls pointing sensitivity at lowest wind velocities and operational durability against extremes of winds, temperature, precipitation and debris accumulation. Scalability of the "sail" span and chord is an important feature of the present warning sign because its "sail" area, i.e., the product of (avg. span) times (avg. chord), governs the size of the ID and warning graphics which are displayed. Detailed regulations and standards for personnel warning signs required for sites where there may be a risk of release of specific toxic gases are issued by and enforced by various Local, State and Federal agencies.

In general, the center of pressure of a symmetric airfoil such as naca-0018 is about 0.25 of the chord downstream from the leading edge. Using this airfoil as an illustration, the most-compact embodiment of the present warning sign includes a zero-length exterior support "beam", i.e., the pivot bearings are placed on the upper and lower edges of rectangular "sail", which forms the integral "beam", as close as possible to the leading edge. For such a configuration, the possible lever-arm length is in the range of 0 to about 0.2*chord. The particular "sail" chord and camber are adapted to provide accurate pointing presuming a lightweight, durable, airfoil structure with a signage area approximately 400 mm square. However, for some installations, this configuration might require use of precision anti-friction bearings chosen and fitted to permit small angular movements ($0<$angle, degrees$<10$) under low wind torques (Beaufort 0-1) even under extreme climate conditions ($-40<$temp, $C<0$).

While such a configuration would allow large signage areas on both sides of the "sail", it would also be subject to significant drag forces during high winds, i.e., deflection of the "sail" skin surfaces and support mast due to violent oscillations of vortex shedding. In some locations, the regular-maintenance costs of such configurations against wind damage and surface-debris accumulation (wind-borne brush or plant matter) might be inordinate compared to alternative embodiments with smaller sails and longer lever arms.

For some remote situations the dominant factor for selecting a warning sign may be maximum robustness along with minimum need for repair or cleaning more frequently than annually. Embodiments of the present invention with lever-arm-lengths in the range 0 to 6 times the average "sail" chord are configured with smaller but compliant warning display areas using known technics such as RFID and QR codes. A ruggedized "beam" and a smaller "sail" are inherently more robust against most signage risk factors for damage and malfunction.

Embodiments with a lever-arm greater than about 0.2*chord provide sails which are pivoted from bearings in a collar sub-assembly of the "beam". The collar is mounted on a vertical mast placed approximately centered in a flat, cleared area, at a predetermined height above the ground and at a specific vector distance from one or more defined sources of possible risks. The collar and "beam" are connected as illustrated in FIG. 5 to allow easy pivoting of the "sail".

Warning information explicit to the site risks, as required under state or federal laws, is displayed in text and color graphics on the visible, external surfaces of the "sail", "beam", collar and mast. An array of different user-friendly QR codes (usually black-and-white graphics about 100-200 mm sq.), which can be imaged with a smartphone from a short distance in daylight, are displayed on selected parts of the sign; these enable predetermined visitors having a password and broadband or cell phone-network web access to view specific information relative to their visit as well as updated facts about risks and hazards. As a special service to selected visitors, optional secure RFID devices and systems are provided on the mast and collar; these provide tamper-proof, reliable access to business—engineering data, emergency plans and other critical information for the site.

"Sail" Parameters and Characteristics

Free-Body Force/Deflection/Movement Considerations of Main "Beam"

From conventional flow modeling studies and several full-scale prototypes, the sails of the present invention are estimated to generate a lift force greater than 0.01 N for winds in the range Beaufort 1-2 striking at an angle of attack of 5 deg. The instant lift force is, of course, a factor of "sail" area, its surface roughness and the specific airfoil profile, e.g., avg. chord, avg. camber and span.

Operationally for the warning sign, this corresponds to an estimated pointing accuracy of about one compass point (+/− about 6 deg) assuming the there are no anomalous factors such as movement obstructions (tumbleweed against the mast) or accumulated dust/sand in the collar and bearings. This accuracy is believed to be sufficient to alert a visitor to the possible upwind risk factors.

Warning System Operations, Functions and Features

The warning system of the present invention includes a dynamic pointing device provided with regulatory-compliant warning signs for the presence of specific toxic fluids and RFID and QR links to facilitate specific classes of site visits, e.g., regular service visits, inspections or emergency crews responding to a toxic release or terrorist attack.

The present signage configurations alert the approaching visitor to the possibility of toxic fluids in the local environment. The active pointing device of the present invention responds to local wind currents and indicates the wind-drift direction of possible already-released or currently escaping substances. The pointing device and its graphics are the first line of awareness about the health risks of a toxic plume and are invaluable in case of: darkness, power outage, failure of local cell services and actual release of heavier-than-air gases. In daylight, the pointing movements of the present invention will alert a naive or unwary visitor to possible dangers. If tanks or pipeline control buildings are visible from the entrance, the visitor will be reminded of their general position, i.e., either upwind or downwind. Presumably all site visitors will have made an appointment and, in some cases, will be accompanied toward the site by an escort carrying toxic-sniffing instruments in addition to a smartphone and an RFID reader for all special tags which are deployed.

The QR code displays of the present system provide a random number (public-key) by which a site visitor is allowed password access (by a specific private-key) to selected additional technical or business data relevant to the site. Each particular class of visit is matched with specific, relevant "user friendly" data/reports arranged in a predetermined format to assist the visitor in completing his work safely and with dispatch. In the case of visits by fire fighters or other emergency teams, these secure links are configured to provide incisive, secure access to all necessary sensitive technical data such as site maps and the current inventory of toxic substances. Using the present system, the emergency responder is not forced to waste time searching within an unfamiliar website on a cell phone or trying to radio or telephone managers who might have critical information. The website visit protocol collects tracking data about: (a) the visit, e.g., time, date, duration, purpose, activities accomplished, settings changed, etc., (b) the visitor, e.g., personal identification, organization represented, special qualifications/fitness, etc., and (c) conditions or status at the site, e.g., weather, status of local power, cell phone, toxic release, fire, explosion etc.

The RFID tag(s) of the present system are configured to provide to the reader a 96 bit random number which is unique for the site and allows private-key web access to selected data which identifies the site and risk factors. An active RFID tag can be read at distances of up to 2 km with a directional antenna, if there are no physical obstructions. A conventional 915 MHz EPC tag can be read at about at distances of about 6 m. The present RFID warning system optimizes the several key range factors including: transmitter power, receiver sensitivity, reader antenna gain, tag antenna gain, tag power drain and efficiency of the tag modulator. Advanced active RFID tags can be configured to collect and store details of: the visit, the visitors as well as ID codes for any personal communications or special computer equipment brought into the site; upon command from an IT administrator, such details can be recalled, reviewed and finally added to a comprehensive visit log. Because RFID tags can be intentionally defeated/compromised by a piece of thin metal foil (~27 micrometer thick Al foil), the present system includes a validation protocol to confirm the functional status of each active and passive tag at every visit.

EXAMPLES OF ALTERNATIVE EMBODIMENTS

Example 1

Pivot downstream of "sail" leading edge. This embodiment exhibits best pointing sensitivity and accuracy with high-lift airfoils.

L1<0.2*chord, rectangular "sail" area about 400×400 mm

"Sail" Parameters

Typical Profile: square to rectangular

Span: approximately equal to or longer than the chord

Chord: in the range 200 to about 600 mm

Camber: in the range 20 to about 100 mm or approximately 0.1 to 0.17 times the chord Display area of each main face: in the range 0.04 to about 0.5 sq. meter Example 2

Pivot upstream of "sail" leading edge. As illustrated in FIG. 7, this embodiment features an upper and a lower bearing support extension projecting forward from the "sail" root and tip planes. These supports extend the pivot arm significantly, i.e., to values of 0.2 to 0.4 times the chord. Each extension is fitted with a low-friction bearing for pivoting the center of pressure about the mast. FIG. 7 also illustrates an array of interpenetrating flow-straightening guides attached to the mast and leading edge; these smooth, thin, rigid elements are fixed parallel and spaced apart to counteract vortices which may be shed from the upstream mast. This embodiment achieves excellent pointing accuracy even in light breezes.

L1>0.2*chord, rectangular "sail" area about 40×400 mm

"Sail" Parameters

Typical Profile: square to rectangular

Span: approximately equal to or longer than the chord

Chord: in the range 200 to about 600 mm

Camber: in the range 20 to about 100 mm or approximately 0.1 to 0.17 times the chord Display area of each main face: in the range 0.04 to about 0.5 sq. meter Example 3

Pivot upstream of "sail" leading edge. This embodiment features smaller, thinner "sails" and is more robust toward extreme winds; because of the longer lever arm for the center of pressure, it achieves excellent pointing accuracy even in light breezes.

L1>0.2*chord, polygonal "sail"

"Sail" parameters

Typical Profiles: multiple 4-gon alternatives including, square, rectangle, parallelogram, trapezoid as well as 3-side, 5-side or 6-side alternatives Span: approximately equal to or longer than the chord Chord: in the range of about 150 to 400 mm Camber: in the range of about 20 to 100 mm or approximately 0.1 to 0.2 times the chord Display area of each main face: in the range of about 0.04 to 0.16 sq. meters Example 4

Eccentric pivot, trapezoid or parallelogram "sail" profile with small area

FIG. 6 illustrates several alternative "sail" profiles.

L1>0.2*chord

"Sail" Parameters

Typical Profile: parallelogram or trapezoid

Span: approximately equal to or longer than the chord

Chord: in the range of about 100 to 200 mm

Camber: in the range of about 15 to 50 mm or approximately 0.15 to 0.2 times the chord Display area of each main face: typically about 0.02 sq. meters Example 5

QR Code Array Added to "Sail"

FIG. 7 illustrates one alternative arrangement of traditional and QR images. FIG. 8 illustrates a few examples of traditional warning icons now in global use.

In this example, multiple 2D QR images: BW or selected colors using fade-resistant pigments, about 100 mm square are fixed to the face surfaces of the "sail" in addition to one or more conventional warning displays of Examples 1-3 above. The images may include special features such as laser-responsive ink or retroreflective materials which are especially valuable under emergency conditions. Ideally, there are separate QR codes for each of: occasional, regular-business, compliance, emergency or DHS visitors. The QR display is of various alternate forms ranging from a simple website link for general public information to a secure random-number unique to the particular site which can be added to private ID codes for a particular visitor to allow connection to predetermined information using a smartphone.

Example 6

QR Codes and RFID Tags on "Sail", "Beam" and Collar

In this example, multiple RFID tags are fixed to the face surfaces of the "sail" in addition to conventional warning displays and QR codes of Examples 1-4 above. FIGS. 4, 5, and 7 illustrate alternative placements of RFID tags and QR codes.

Additionally, advanced, special-function active and passive RFID tags are fastened to areas of the mast and collar which are easily visible to an approaching visitor. FIG. 7 illustrates placements of RFID tags on the mast and bearing support. This configuration facilitates both normal and emergency RFID interactions at the choice of a visitor, e.g., a firefighter.

Example 7

Multiple Warning Signs, "Logical QR Codes" and RFID Tags Prepared as Inserts

In this example embodiment, the sign surfaces are provided with fastening devices appropriate for secure attachment of selected message items included in a kit. The kit contains a targeted selection of: retroreflective warning images (item 1, FIG. 7), ID images (item 2, FIG. 7), "logical QR emblems" (items 3-7, FIG. 7) and RFID tags (active and passive types, FIG. 7). The "logical QR emblems" include "user friendly", authorized variants of registered logos of firms, organizations, government agencies along with 2D digital codes representing the random number assigned to the entity. This allows instant recognition by emergency responders of the triage data needed for their work and provides immediate, secure web links to retrieve the actual data by a dedicated reader, palmtop, laptop or smartphone.

Example 8

Kit Containing Multiple Structural Components of Different Sign Embodiments

In this example, the kit is provided with a selected set of "sails", beams, bearings, counterweights, circuit packages, PV devices and rechargeable batteries, and masts. This kit allows a specialist technician to field assemble a reliable, optimized security system of this invention appropriate for installation at a site which may be exposed to extreme conditions of wind and weather.

We claim:

1. A wind-articulated, secure warning system responsive to oblique wind currents acting external to surfaces of its exposed, non-flat-sheet and non-fabric structural elements which does not provide any wind-velocity indications and which provides a functional-airfoil-cross-section surface configured to display and provide emergency critical technical data for specific classes of regular and emergency visitors to the entrance portal of an industrial site where large quantities of dangerous substances, including, radioactive, flammable, explosive, corrosive, oxidizing, asphyxiating, biohazardous, toxic, pathogenic, or allergenic substances are handled and which substances might be released by accident or by terrorist attack and dispersed by winds into the local environment, the system comprising:

each visitor to the site provided with predetermined personal handheld devices including a known, portable RFID tag reader and/or a smartphone for graphic web access and for transferring spoken or key-entered passwords, said devices allowing confirmation of a particular level of security clearance and enabling physical access to the site and, if needed, maximum-security-web-access to critical site information prior to entry therein;

a rigid support mast which extends vertically about 2-10 m above the ground surface, the mast being placed generally in the center of a cleared and leveled area of ground surface about 10 m in radius, the mast having a width of about 40-70 mm and at least one mast-lateral-display surface visible to entering visitors;

a wind-responsive, stiffened, monocoque panel formed of thin sections of lightweight materials into the general shape of a polygon, the panel being a smooth, thin, symmetrical airfoil, said panel defined by opposed first and second panel-lateral-face surfaces and having characteristic span, chord, thickness L4, plane of symmetry, a center of lift, a leading edge, a trailing edge, a root and an outboard tip, the panel further connected to said mast for unobstructed, 360 degree rotation thereabout, the airfoil oriented so that its plane of symmetry lies parallel to the axis of the mast and its chord is generally perpendicular to the mast axis;

said panel being pivotably mounted to the mast by mechanical connection to one or more lightweight monocoque, support beams which have an airfoil shape in plan view, extend perpendicular to said mast axis upstream of the leading edge of said panel, said one or more beams providing beam-lateral-display surfaces and mechanical connection of said panel to the mast and adapting it for full rotation thereabout at wind velocities as low as 0.5 m/sec, whereby the center of lift of said airfoil is offset a distance of at least a distance L1~0.2*chord downstream from the mast axis;

each of said one or more beams being provided with low-friction bearings adapted for thrust loads and for rotation under extreme weather conditions;

each of said panel-lateral-face surfaces provided with one or more displays of encoded and readable messages;

said one or more panel-displays including text, and graphics to provide warning data along with related iconic symbols in grayscale and/or color;

said panel lateral-face surfaces being provided with one or more regulatory-compliant, retroreflective exterior signs indicating in text, colors, icons and special QR-type digital graphics, certain information on characteristics of the dangerous substances and the particular site, the QR codes facilitating password-controlled web access by the visitor's personal handheld devices to predetermined additional sensitive data, including layout diagrams;

said lateral display surfaces of said mast and said one or more beams being provided with at least one secure, robust RFID-tag device oriented toward the direction from which visitors approach and which can be accessed by means of a visitor-carried, secure reader to obtain updated, critical or sensitive data on particular aspects of the site; and whereby a visitor, having the use of a secure portable tag reader and/or smartphone, is informed prior to admittance or actual entry into the site, of relevant critical intelligence data, safety information about the site and instant risks of exposure to dangerous substances.

2. The secure warning system of claim 1 comprising:

said panel being an airfoil having the following characteristics 250<span, mm<1000; 250<chord, mm<1000; 10<thickness L4, mm<100; its leading edge is generally parallel to said mast axis; its span being oriented in a vertical plane parallel to the axis of said mast;

said airfoil panel being a rectangular polygon and fixed between a first lower beam at its root and a second upper beam at its tip, both said beams being attached to said mast for 360-degree rotation thereabout;

said offset, L1, of airfoil center of lift re the pivot axis being in the range 0.2*chord to 0.6*chord;

said airfoil panel being able to generate lift forces in the range 0.1<force, N<0.5 at 3-degree oblique-angle wind velocities as low as 0.3 m/sec; and said panel-face surfaces adapted for direct application of thin-layer-designs using known all-weather paints and pigments and known sign-image-generation methods.

3. The secure warning system of claim 2 comprising:

said panel being quadrilateral in the form of a parallelogram, a rhombus or a trapezoid with its leading edge not generally parallel to the mast axis;

said beams and bearings being adapted for rotation under a force of about 0.1 N applied perpendicular to one of said lateral surfaces at said airfoil center of lift;

said mast, beams and panel being designed to resist drag forces of strong winds in the range 2<velocity, m/sec<30 with elastic deflections of less than 1%;

said mast-mounted beam-&-panel assembly being adapted to rotate under 0.5-5 deg. oblique angle wind currents in the velocity range 3-40 m/sec and to align itself substantially parallel to the instant wind vector; and said panel-face surfaces being adapted for one or more of: (a) semi-permanent fixation of known adhesive-backed warning signs in the form of known materials in the thickness range 0.05-3 mm, (b) permanent fixation of warning signs mated to panel-surface recesses using known technics to achieve substantially flush mounting of said signs in the thickness range 0.05-3 mm and (c) removable fixation of warning signs mated to panel-surface recesses using known securing technics to achieve weatherproof, substantially-flush mounting of said signs in the thickness range 0.05-3 mm.

4. The secure warning system of claim 1 comprising;

said panel being an airfoil having the following characteristics 250<span, mm<1000; 250<chord, mm<1000;

10<thickness L4, mm<100; its leading edge is generally parallel to said mast axis; its span being oriented in a vertical plane parallel to the axis of said mast;

said airfoil panel being a rectangular polygon and fixed at its root upon a support beam, said beam being attached to said mast for 360-degree rotation thereabout;

said offset, L1, of airfoil center of lift re the pivot axis being in the range 0.2*chord to 4*chord; and said panel-face surfaces adapted for direct application of thin-layer-designs using known all-weather paints and pigments and known sign-image-generation methods.

5. The secure warning system of claim 4 comprising:

said panel being quadrilateral in the form of a parallelogram, a rhombus or a trapezoid with its leading edge not generally parallel to the mast axis; and said panel-face surfaces being adapted for one or more of: (a) direct application of thin-layer-warning-designs using known all-weather paints and pigments and known sign-image-generation methods, (b) semi-permanent fixation of known adhesive-backed warning signs in the form of known materials in the thickness range 0.05-3 mm, (c) permanent fixation of warning signs mated to panel-surface recesses using known technics to achieve substantially flush mounting of said signs in the thickness range 0.05-3 mm and (d) removable fixation of warning signs mated to panel-surface recesses using known securing technics to achieve weatherproof, substantially-flush mounting of said signs in the thickness range 0.05-3 mm.

6. The secure warning system of claim 5 comprising:

said beams and bearings being adapted for rotation under a force of about 0.1 N applied perpendicular to one of said lateral surfaces at said airfoil center of lift;

said mast, beams and panel being designed to resist drag forces of strong winds in the range 2<velocity, m/sec<30 with elastic deflections of less than 1%;

said mast-mounted beam-&-panel assembly being adapted to rotate under 0.5-5 deg. oblique-angle wind currents in the velocity range 3-40 m/sec and to align itself substantially parallel to the instant wind vector; and said panel-face surfaces being adapted for one or more of: (a) direct application of thin-layer-warning-designs using known all-weather paints and pigments and known sign-image-generation methods, (b) semi-permanent fixation of known adhesive-backed warning signs in the form of known materials in the thickness range 0.05-3 mm, (c) permanent fixation of warning signs mated to panel-surface recesses using known technics to achieve substantially flush mounting of said signs in the thickness range 0.05-3 mm and (d) removable fixation of warning signs mated to panel-surface recesses using known securing technics to achieve weatherproof, substantially-flush mounting of said signs in the thickness range 0.05-3 mm.

7. The secure warning system of claim 4 comprising:

said beam is provided with one or more counterweights of materials exhibiting a density of at least 2000 kg/m3 and said counterweights are all offset upstream from said mast axis, the ensemble providing a combined moment to substantially balance the opposing static moment in the panel plane of symmetry due to the combined mass of beam and panel portions located downstream of the pivot axis, wherein said counterweights are one or more of: (a) all internal or all external to said beam surface, (b) at least one of said counterweights is external, (c) all of said counterweights are permanently attached and (d) at least one of said counterweights is separately and removably attached; and said panel is provided at its tip with one or more known winglets each having optimized design features including: cant angle, twist distribution, sweepback and taper ratio whereby vibration and drag of said panel are substantially reduced under wind velocities of more than 10 m/sec.

8. The secure warning system of claim 6 comprising:

said beam is provided with one or more counterweights of materials exhibiting a density of at least 2000 kg/m3 and said counterweights are all offset upstream from said mast axis, the ensemble providing a combined moment to substantially balance the opposing static moment in the panel plane of symmetry due to the combined mass of beam and panel portions located downstream of the pivot axis, wherein said counterweights are one or more of: (a) all internal or all external to said beam surface, (b) at least one of said counterweights is external, (c) all of said counterweights are permanently attached and (d) at least one of said counterweights is separately and removably attached; and said panel is provided at its tip with one or more known winglets each having optimized design features including: cant angle, twist distribution, sweepback and taper ratio whereby vibration and drag of said panel are substantially reduced under wind velocities of more than 10 m/sec.

9. The secure warning system of claim 4 comprising:

said beam is provided with one or more counterweights of materials exhibiting a density of at least 2000 kg/m3 and said counterweights are all offset upstream from said mast axis, the ensemble providing a combined moment to substantially balance the opposing static moment in the panel plane of symmetry due to the combined mass of beam and panel portions located downstream of the pivot axis, wherein said counterweights are one or more of: (a) all internal or all external to said beam surface, (b) at least one of said counterweights is external, (c) all of said counterweights are permanently attached and (d) at least one of said counterweights is separately and removably attached; and said panel is provided at its tip with one or more known winglets each having optimized design features including: cant angle, twist distribution, sweepback and taper ratio whereby vibration and drag of said panel are substantially reduced under wind velocities of more than 10 m/sec.

10. A packaged kit of parts for assembling and mounting a site-customized, wind-articulated, all-weather warning and security system adapted to engage wind currents upon its externally-exposed, non-flat-sheet and non-fabric functional-airfoil-cross-section surfaces and structural elements and which does not provide any wind-velocity indications especially configured to meet the particular emergency, business, regulatory and legal requirements for weather-resistant warning signs placed adjacent a particular industrial site where large quantities of toxic-fluid substances are handled and which substances might be released and dispersed into the local environment by accident or by terrorist attack, the system adapted to: (a) inform and monitor visitors provided with paired-secure portable wireless communications devices, (b) indicate the instant wind direction visually and (c) to display visual site information and provide URL data for wireless links to warnings as well as other data, the kit comprising:

an assembly manual which specifies the characteristics of all the kit components, identifies assembly procedures along with mating features, elements and related known fasteners and also contains resulting performance technical data on alternative combinations of said components for selected typical risk situations, selected known RFID and handheld devices as well as identification of special QR codes, said manual also including phone and email links for assistance on configuring a warning system for peculiar and new situations not illustrated therein;

a set of masts suitable for mounting vertically into an area of cleared ground adjacent the entry portal of the site, each mast defined by its centerline or axis, being made of specific materials and having particular cross-section shapes, widths, lengths, strengths and stiffnesses;

a set of size-graded, polygonal, light-weight, all-weather, symmetric-airfoil pointing panels, each having two opposed, smooth face surfaces, each said panel characterized by plane of symmetry, surface features adapted for mounting of one or more warning signs covering about 10-80% of the face-surface area as well as a particular span, chord, thickness and center of pressure;

a set of support beams each provided with known mechanical coupling features adapted to assemble matingly and rigidly together with selected ones of the panels, wherein each said beam provides one or more enclosed, known low-friction pivot bearings for its connection to and free rotation about selected ones of said masts, said features providing: (a) a particular offset distance between the center of pressure of the selected panel fixed thereupon and the pivot axis as defined by said mast axis and (b) orientation of the plane of symmetry of selected said fixedly-attached panel parallel to said mast axis when said beam is connected thereto;

a size-graded set of known, thin warning signs especially adapted for surface mounting on said panels, including retroreflective versions for each risk class, each said sign appropriate for a particular site risk including: biohazards, toxic substances, radiation, high-voltage, lasers, intense sounds, dangerous machines, explosives etc., and each attachable to a face surface and wherein certain of said warning signs are of a special, unique design adapted to provide coded information to specific first responders;

a set of known RFID devices, including known active and passive types, each operable from a reader carried by said specific visitors, each tag adapted for mounting at a specific location on the panel, beam or mast, wherein the visitor's portable devices are able to display additional and secure information related to the site upon provision of secure password(s);

a set of unique, customized warning signs provided with QR code graphics and adapted to provide a web or smartphone link for assistance to specific classes of site visitors, each said QR graphic prepared on thin, weather-resistant sheet stock and adapted to mount on the face surface of the panel, beam or mast, wherein each of the several classes of visitors is provided with secure web access to additional, predetermined information essential to safety and visit effectiveness; and whereby a site-customized warning system is assembled and mounted by a trained specialist taking into account the particular toxic-fluid substances and the site-specific risk factors, which system provides visitors using a paired, secure, portable wireless device with instant, local wind-direction awareness and updated visitor-class-specific and/or emergency information delivered by user friendly, advanced technics.

11. The packaged kit of parts of claim 10 further comprising:

said panel-face surfaces being adapted for one or more of: (a) direct application of thin-layer-warning-designs using known all-weather paints and pigments and known sign-image-generation methods, (b) semi-permanent fixation of known adhesive-backed warning signs in the form of known materials in the thickness range 0.05-3 mm, (c) permanent fixation of warning signs mated to panel-surface recesses using known technics to achieve substantially flush mounting of said signs in the thickness range 0.05-3 mm and (d) removable fixation of warning signs mated to panel-surface recesses using known securing technics to achieve weatherproof, substantially-flush mounting of said signs in the thickness range 0.05-3 mm; and each said mast-mounted beam-&-panel assembly being adapted to rotate under 0.5-5 deg. oblique-angle wind currents in the velocity range 3-40 m/sec and to align itself substantially parallel to the instant wind vector.

12. An improved, dynamic, critical-warning system adapted to inform, warn and protect first responders which is placed at the entry portal to a site where large quantities of dangerous substances are being handled and which may be subject to accidental or terrorist-attack releases of toxic and/or dangerous substances, including wind-dispersable gases, sprays and aerosols, the system intended to provide updated, secure wireless links to critical information about the site for the purpose of alerting first responders to immediate potential hazards relating to emergency work being done in the vicinity, the improved warning system comprising:

each said first responder to the site provided with predetermined personal handheld devices including a known, portable RFID tag reader and/or a smartphone for graphic web access and for transferring spoken or key-entered passwords, said devices allowing confirmation of a particular level of security clearance and enabling physical access to the site and, if needed, maximum-security-web-access to critical site information prior to entry therein;

a rigid support mast which extends vertically about 2-10 m above the ground surface, the mast being placed generally in the center of a cleared and leveled area of ground surface about 10 m in radius, the mast having a width of about 40-70 mm and at least one mast-lateral-display surface visible to entering first responders;

a wind-responsive, stiffened, monocoque panel formed of thin sections of lightweight materials into the general shape of a polygon, the panel being a smooth, thin, symmetrical airfoil, said panel defined by opposed first and second panel-lateral-face surfaces and having characteristic span, chord, thickness L4, plane of symmetry, a center of lift, a leading edge, a trailing edge, a root and an outboard tip, the panel further connected to said mast for unobstructed, 360 degree rotation thereabout, the airfoil oriented so that its plane of symmetry lies parallel to the axis of the mast and its chord is generally perpendicular to the mast axis;

said panel being pivotably mounted to the mast by mechanical connection to one or more lightweight monocoque, support beams which have an airfoil shape in plan view, extend perpendicular to said mast axis upstream of the leading edge of said panel, said one or more beams providing beam-lateral-display surfaces and mechanical connection of said panel to the mast and adapting it for full rotation thereabout at wind velocities as low as 0.5 m/sec, whereby the center of lift of said airfoil is offset a distance of at least a distance L1~0.2*chord downstream from the mast axis;

said panel lateral-face surfaces being provided with one or more regulatory-compliant, retroreflective exterior signs indicating in text, colors, related iconic symbols in grayscale or color and special QR-type digital graphics, certain information on characteristics of the dangerous substances and the particular site, the QR codes facilitating password-controlled web access by the visitor's personal handheld devices to predetermined additional sensitive data, including layout diagrams;

said lateral display surfaces of said mast and said one or more beams being provided with at least one secure, robust RFID-tag device oriented toward the direction from which visitors approach and which can be accessed by means of a visitor-carried, secure reader to obtain updated, critical or sensitive data on particular aspects of the site; and whereby a visitor, having the use of a secure portable tag reader and/or smartphone, is informed prior to admittance or actual entry into the site, of wind direction, relevant critical intelligence data, safety information about the site and instant risks of exposure to dangerous substances.

* * * * *